US006278415B1

(12) United States Patent
Matsuyoshi et al.

(10) Patent No.: US 6,278,415 B1
(45) Date of Patent: Aug. 21, 2001

(54) MULTI-FILAR HELICAL ANTENNA AND PORTABLE RADIO

(75) Inventors: Toshimitsu Matsuyoshi, Katano; Koichi Ogawa, Hirakata; Hiroyuki Nakamura, Neyagawa; Kenichi Takahashi, Kawasaki, all of (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/236,463

(22) Filed: Jan. 25, 1999

(51) Int. Cl.[7] ..... H01Q 1/36
(52) U.S. Cl. ..... 343/895; 343/702
(58) Field of Search ..... 343/895, 702, 343/820, 850, 853, 876, 858; 455/13.3

(56) References Cited

U.S. PATENT DOCUMENTS

| | | | | |
|---|---|---|---|---|
| 4,011,567 | * | 3/1977 | Ben-Dov | 343/853 |
| 5,594,461 | * | 1/1997 | O'Neill, Jr. | 343/895 |
| 5,640,689 | | 6/1997 | Rossi | 455/89 |
| 5,706,019 | * | 1/1998 | Darden, IV et al. | 343/895 |
| 5,896,113 | * | 4/1999 | O'Neill, Jr. | 343/895 |
| 6,005,521 | * | 12/1999 | Suguro et al. | 343/700 MS |
| 6,025,816 | * | 2/2000 | Dent et al. | 343/895 |
| 6,034,650 | * | 3/2000 | Kuramoto | 343/895 |
| 6,075,501 | * | 6/2000 | Kuramoto et al. | 343/895 |
| 6,133,891 | * | 10/2000 | Josypenko | 343/895 |

FOREIGN PATENT DOCUMENTS 0 169 823 1/1988 (EP) .

OTHER PUBLICATIONS

A. Sharaiha et al. "Printed Quadrifilar Resonant Helix Antenna Integrated Feeding Network" *Electronics Letters*, GB, IEE Stevenage vol. 33, No. 4, Feb. 13, 1997 pp. 256–257.

Paul Shumaker et al. "A New GCPW Resonant Quadrifilar Helix Antenna For GPS Land Mobile Applications" *IEEE Antennas and Propagation Society International Symposium* US, New York, NY:IEEE, Jul. 14, 1997 pp. 1344–1347.

* cited by examiner

*Primary Examiner*—Don Wang
*Assistant Examiner*—Trinh Vo Dinh
(74) *Attorney, Agent, or Firm*—Smith, Gambrell & Russell, LLP

(57) ABSTRACT

A multi-filar helical antenna has an antenna radiant section which has n elements which are wound in spiral, and a phase control part which feeds signal to the n elements with a phase delay of 360°/n each in the order of an arrangement of the n elements or a phase lead of 360°/n each in the order of the arrangement of the n elements.

7 Claims, 10 Drawing Sheets

MULTI-FILAR HELICAL ANTENNA AND PORTABLE RADIO

BACKGROUND OF THE INVENTION

1. Field of the Invention

The present invention relates to a multiple-wire wound helical antenna which is used mainly for a mobile radio device such as a portable telephone.

2. Related Art of the Invention

The recent years have seen a rapid development of mobile telecommunication such as portable telephones, and as a result, not only portable telephone systems using ground stations are wanted but systems using satellites as well are expected. Meanwhile, an antenna is one of important devices of a portable telephone terminal.

In the following, an example of a conventional quadrifilar helical antenna mentioned above will be described with reference to an associated drawing.

FIG. 9 is a block diagram showing a conventional quadrifilar helical antenna. In FIG. 9, denoted at 201 is a quadrifilar helical antenna radiant section, denoted at 202 is a 3 dB hybrid, and denoted at 203 is an input/output terminal. An operation of the quadrifilar helical antenna having such a structure will be described below.

The quadrifilar helical antenna 201, when dimensioned to have an appropriate size and fed at the input/output terminal 203 through the 3dB hybrid 202, exhibits radiation pattern having a conical beam characteristic as that shown in FIG. 10.

However, since the directivity is always upward with such a structure described above, if this antenna is disposed to a portable telephone which utilizes a satellite, the directivity becomes downward with the antenna folded during stand-by, whereby a radio wave from above is failed to be received.

SUMMARY OF THE INVENTION

In view of such a problem with the conventional technique, the present invention aims at providing a multi-filar helical antenna which exhibits an upward directivity not only when stretched but even when folded as well.

The present invention is directed to a multi-filar helical antenna which comprises: an antenna radiant section which comprises n elements which are wound in spiral; and phase control means which feeds a signal to the n elements with a phase delay of 360°/n each in the order of an arrangement of the n elements or a phase lead of 360°/n each in the order of the arrangement of the n elements.

The present invention is also directed to a multi-filar helical antenna which comprises: an antenna radiant section which comprises four elements which are wound in spiral; two feed lines which are connected to the antenna radiant section and have substantially the same electrical length with each other; a 3 dB hybrid which comprises four terminals; and two terminating circuits, wherein two on one side out of the four terminals of the 3 dB hybrid are connected to the two feed lines, two on the other side out of the four terminals of the 3 dB hybrid are connected to a switch which switches a connection state with a signal input/output portion, two connection circuits for connecting the switch to two terminals out of the four terminals of the 3 dB hybrid are respectively connected to terminating circuits, and wherein when the signal input/output portion is conducted with either one of two terminals of the 3 dB hybrid as the switch switches over, non-conducting one of the terminals is terminated by one of the terminating circuits which is connected to the non-conducting terminal.

With such structures according to the present invention, by means of a switch, it is possible to switch the directivity of an antenna between an upward direction and a downward direction. Hence, when the antenna is attached to a portable radio terminal, it is possible to direct the directivity of the antenna always to above regardless of whether the antenna is stretched or folded.

DESCRIPTION OF THE PREFERRED EMBODIMENTS

In the following, the present invention will be described in relation to preferred embodiments, with reference to the associated drawings.

Figure 1:
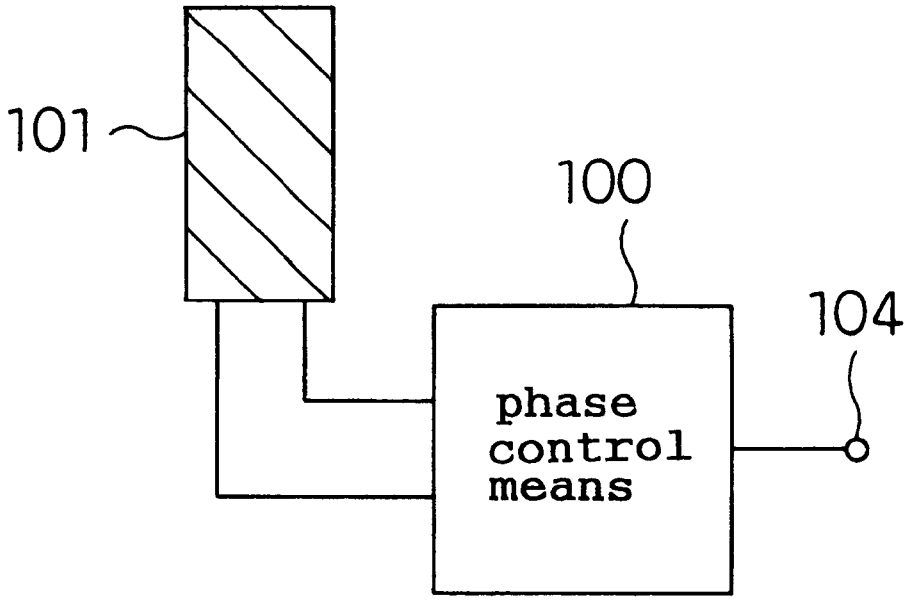
FIG. 1 is a schematic diagram of a quadrifilar helical antenna according to a preferred embodiment of the present invention.
Figure 2:
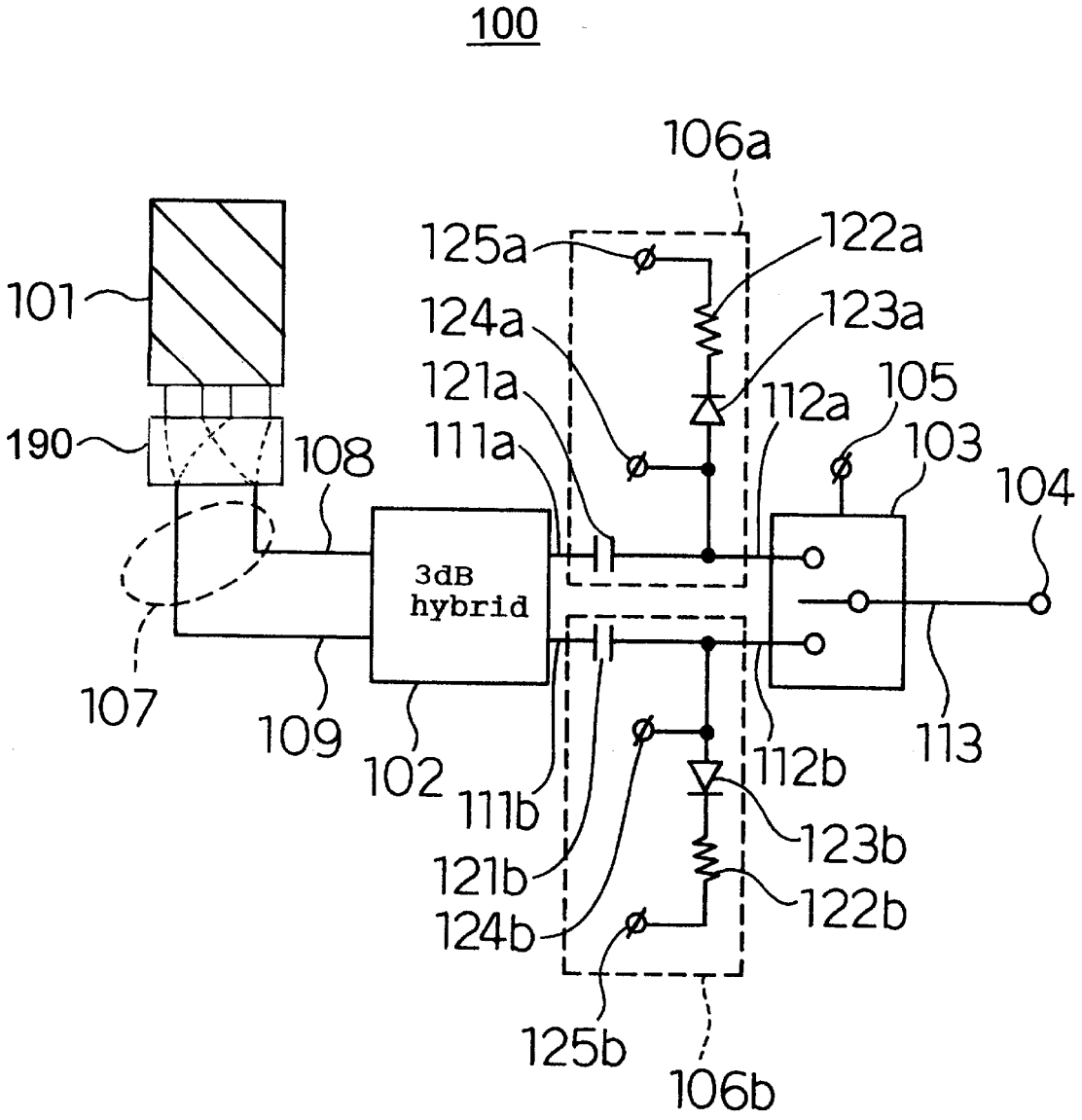
FIG. 2 is a circuitry diagram of the quadrifilar helical antenna according to the preferred embodiment of the present invention.

FIG. 1 is an abstract circuitry diagram of a quadrifilar helical antenna according to a preferred embodiment of the present invention, and FIG. 2 specifically shows the quadrifilar helical antenna. In FIGS. 1 and 2, denoted at 101 is a quadrifilar helical antenna radiant section, denoted at 102 is a 3dB hybrid, denoted at 103 is a switch, denoted at 104 is an input/output terminal, and denoted at 105 is a control terminal of the switch 103.

Denoted at 106*a* and 106*b* are circuits for 50 Ω-terminating non-conducting other terminal when one terminal of the switch 103 conducts. Denoted at 107 are feed lines, denoted at 108, 109, 111*a* and 111*b* are input/output terminals of the 3 dB hybrid 102, denoted at 112*a* and 112*b* are connection terminals of the switch 103, and denoted at 113 is a common terminal of the switch 103. Denoted at 190 is a circuit in which two terminals are connected to the two feed lines 107, and two output terminals branch out from one of the two terminals and other two output terminals branch out from the other one of the two terminals. Four lines of the helical antenna are connected to the four output terminals, respectively. At the branches, signals are out of phase 180 degrees from each other.

A circuit structure of the terminating circuit 106*a* will now be described. Denoted at 121*a* is a d.c. cut capacitor, denoted at 122*a* is a resistor, denoted at 123*a* is a diode, and denoted at 124*a* and 125*a* are control terminals. The d.c. cut capacitor 121*a* is connected between one terminal 111*a* of the 3 dB hybrid 102 and the connection terminal 112*a* of the switch 103. The terminating circuit 106*a* is described as follows.

The resistor 122*a* and the diode 123*a* are connected between the control terminals 124*a* and 125*a,* and the control terminal 124*a* is connected between the d.c. cut capacitor 121*a* and the connection terminal 112*a* of the switch 103.

Like the terminating circuit 106*a,* in the circuit 106*b* as well, a d.c. cut capacitor 121*b* is connected between the terminal 111*b* of the 3 dB hybrid 102 and the connection terminal 112*b* of the switch 103, and a series circuit of the diode 123*b* and the resistor 122*b* is connected to the connection terminal 112*b* of the switch 103. Further, the diode 123*b* and the resistor 122*b* which are connected in series to each other are connected between the two control terminals 124*b* and 125*b*.

Next, a circuit structure of the quadrifilar helical antenna according to the preferred embodiment above will be described. The quadrifilar helical antenna radiant section 101 is connected to the two feed lines 107 (108, 109) which have the same electrical length with each other through a circuit 100, the feed lines 107 are connected to the terminals 108, 109 of the 3 dB hybrid 102, the terminal 111*a* of the 3 dB hybrid 102 is connected to the connection terminal 112*a* of the switch 103 through the circuit 106*a,* and the terminal 111*b* of the 3 dB hybrid is connected to the connection terminal 112*b* of the switch 103 through the circuit 106*b*. Further, the common terminal 113 of the switch 103 is connected to the input/output terminal 104.

Figure 3:
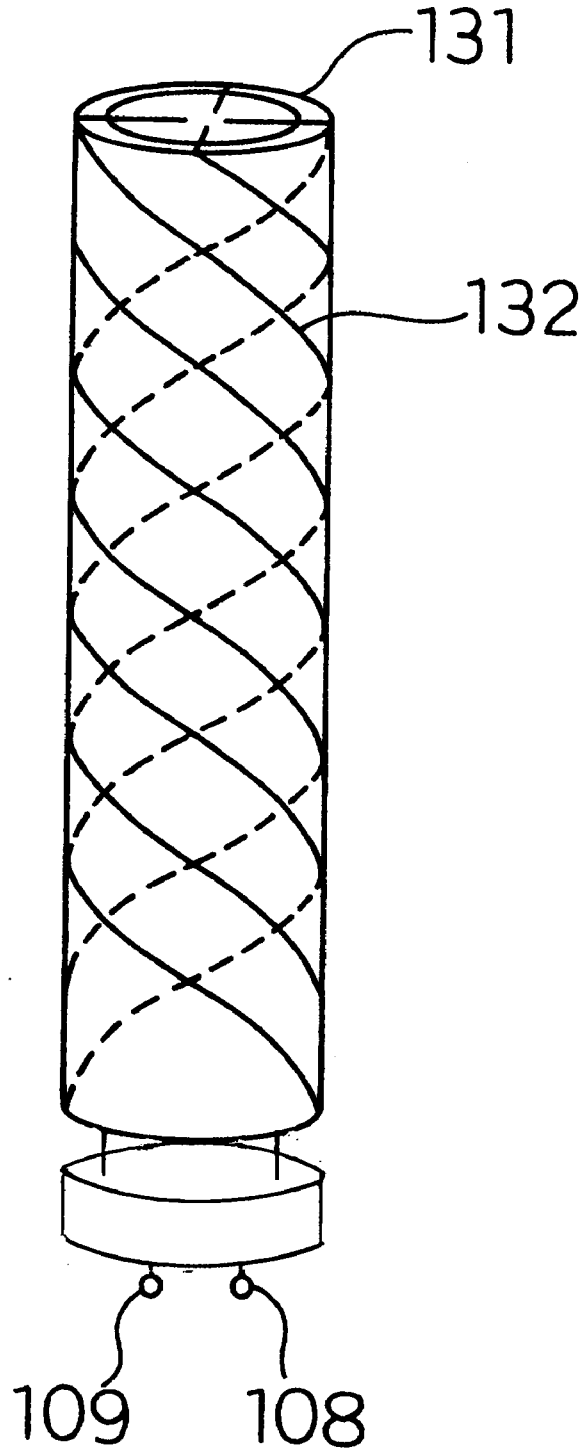
FIG. 3 is a structure diagram of the quadrifilar helical antenna according to the preferred embodiment.

FIG. 3 shows a structure of the radiant section of the quadrifilar helical antenna according to the preferred embodiment. In FIG. 3, denoted at 131 is a hollow cylinder of a resin, while denoted at 132 are antenna elements of metal. The four metal elements are wound around the resin cylinder 131 in spiral with equal pitches between each other and at equal intervals. With respect to the size, a winding diameter is about 0.1 wavelength and a winding pitch is about 0.5 wavelength, for example. In addition,teflon is used as the hollow cylinder 131, and copper wires are used as the antenna elements 132, for instance.

Now, operations of the quadrifilar helical antenna having such a structure described above will be described with reference to FIGS. 1 through 5.

Figure 4:
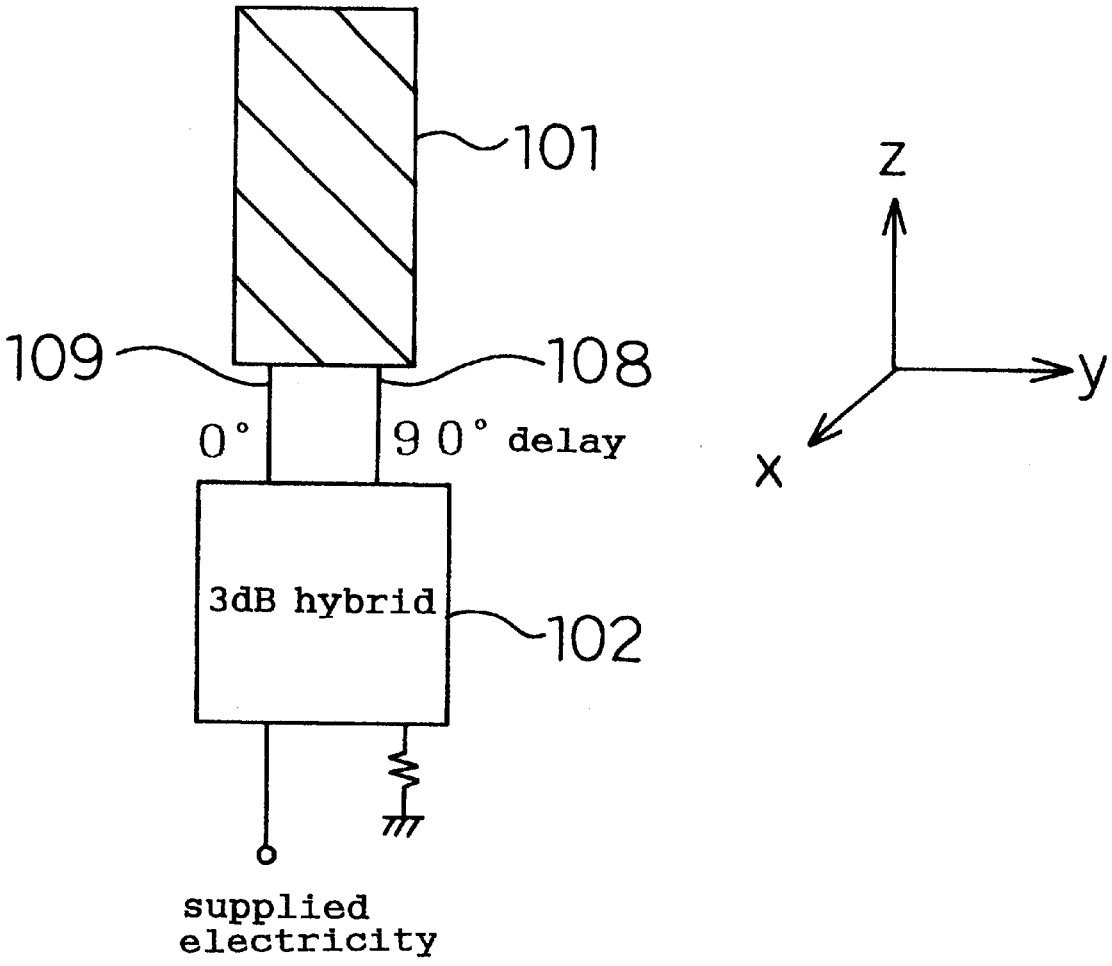
FIGS. 4 and 5 are views showing a method of feeding signal to the quadrifilar helical antenna according to the preferred embodiment.
Figure 5:
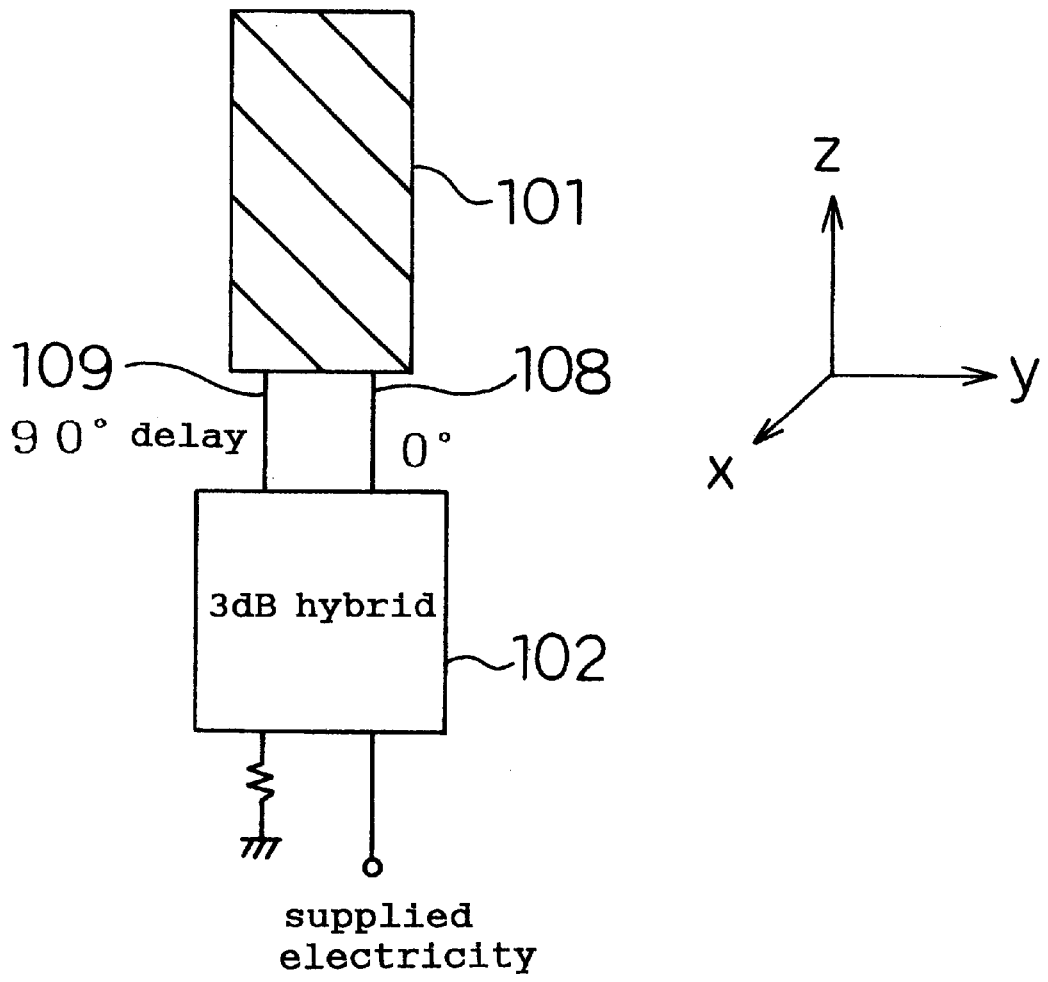

First, operations of the quadrifilar helical antenna will be described with reference to FIGS. 3 through 5.

A radiation characteristic of the quadrifilar helical antenna 101 according to the preferred embodiment is a conical beam characteristic and the direction changes depending on the phase of fed signal. Considering coordinate axes as shown in FIG. 4, when the phase of fed signal at the terminal 108 is delayed 90 degrees with respect to the phase of fed signal at the terminal 109, the directivity is toward a direction +z as denoted at the solid line in FIG. 6. Meanwhile, when the phase of fed signal at the terminal 109 is delayed 90 degrees with respect to the phase of fed signal at the terminal 108, the directivity is toward a direction −z as denoted at the dotted line in FIG. 6. Thus, by switching the phases of fed signal to the terminals 108 and 109, it is possible to control the direction of the directivity.

Such switching of the phases of supplied electricity is realized as associated input terminals are switched by means of the 3 dB hybrid 102.

Now, operations of the circuit according to the preferred embodiment will be described.

The switch 103, in response to a control voltage at the control terminal 105, switches the connection terminals 112*a* and 112*b* as a terminal to conduct with the common terminal 113. For example, when a voltage at the control terminal 105 is at a high level, the common terminal 113 and the connection terminal 112*a* conduct with each other, whereas when a voltage at the control terminal 105 is at a low level, the common terminal 113 and the connection terminal 112*b* conduct with each other.

Figure 6:
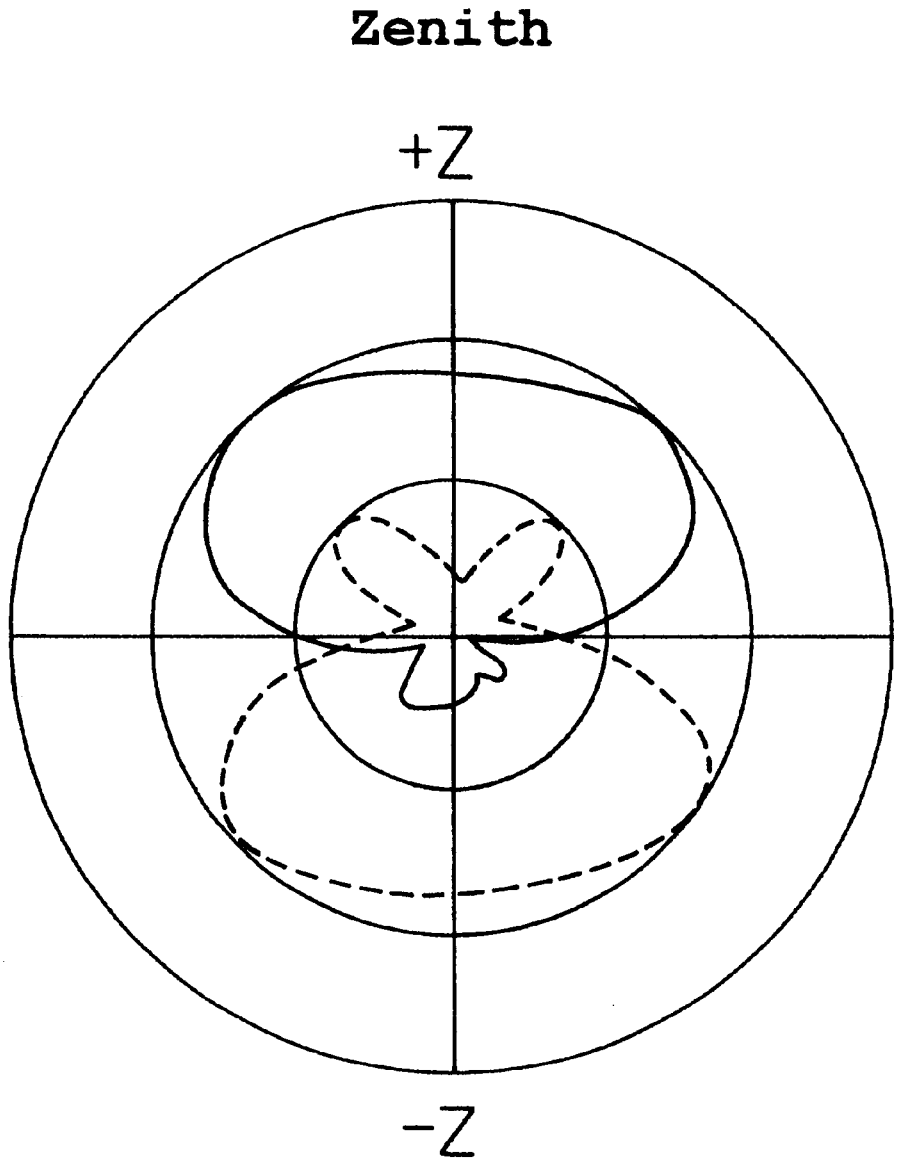
FIG. 6 is a view showing a radiation pattern of the quadrifilar helical antenna according to the preferred embodiment.

Now, a case in which voltages at the control terminals 105, 124*b* and 125*a* are at a high level and voltages at the control terminals 124*a* and 125*b* are at a low level will be considered. In this situation, the switch 103 allows the common terminal 113 and the connection terminal 112*a* to conduct with each other. For transmission, for instance, a signal inputted at the input/output terminal 104 is supplied to the 3 dB hybrid 102 through the terminal 111*a*. As a result, the phase of an output at the terminal 109 lags 90 degrees with respect to the phase of an output at the terminal 108 as shown in FIG. 5. Hence, a radiation characteristic of the antenna as that denoted at the dotted line in FIG. 6 is obtained. In addition, since the diode 123*a* is off and the diode 123*b* is on at this stage, the terminal 111*b* of the 3 dB hybrid 102 is terminated at the resistor 122*b*. When the resistor 122*b* has 50 Ω, the terminal 111*b* is 50 Ω-terminated.

Conversely, voltages at the control terminals 105, 124*b* and 125*a* are at a low level and voltages at the control terminals 124*a* and 125*b* are at a high level, the switch 103 allows the common terminal 113 and the connection terminal 112*b* to conduct with each other. Hence, a signal inputted at the input/output terminal 104 is supplied to the 3 dB hybrid 102 through the terminal 111*b*. As a result, the phase of an output at the terminal 108 lags 90 degrees with respect to the phase of an output at the terminal 109 as shown in FIG. 4. Therefore, a radiation characteristic of the antenna as that denoted at the solid line in FIG. 6 is obtained. Since the diode 123*a* is on and the diode 123*b* is off at this stage, the terminal 111*a* of the 3 dB hybrid 102 is terminated at the resistor 122*a*. When the resistor 122*a* has 50 Ω, the terminal 111*a* is 50 Ω-terminated.

In this manner, although switch-over performed by the switch makes one of the terminals 111*a* and 111*b* of the 3 dB hybrid 102 a terminal which does not pass a signal, the one of the terminals is terminated with the terminating resistor.

Figure 8:
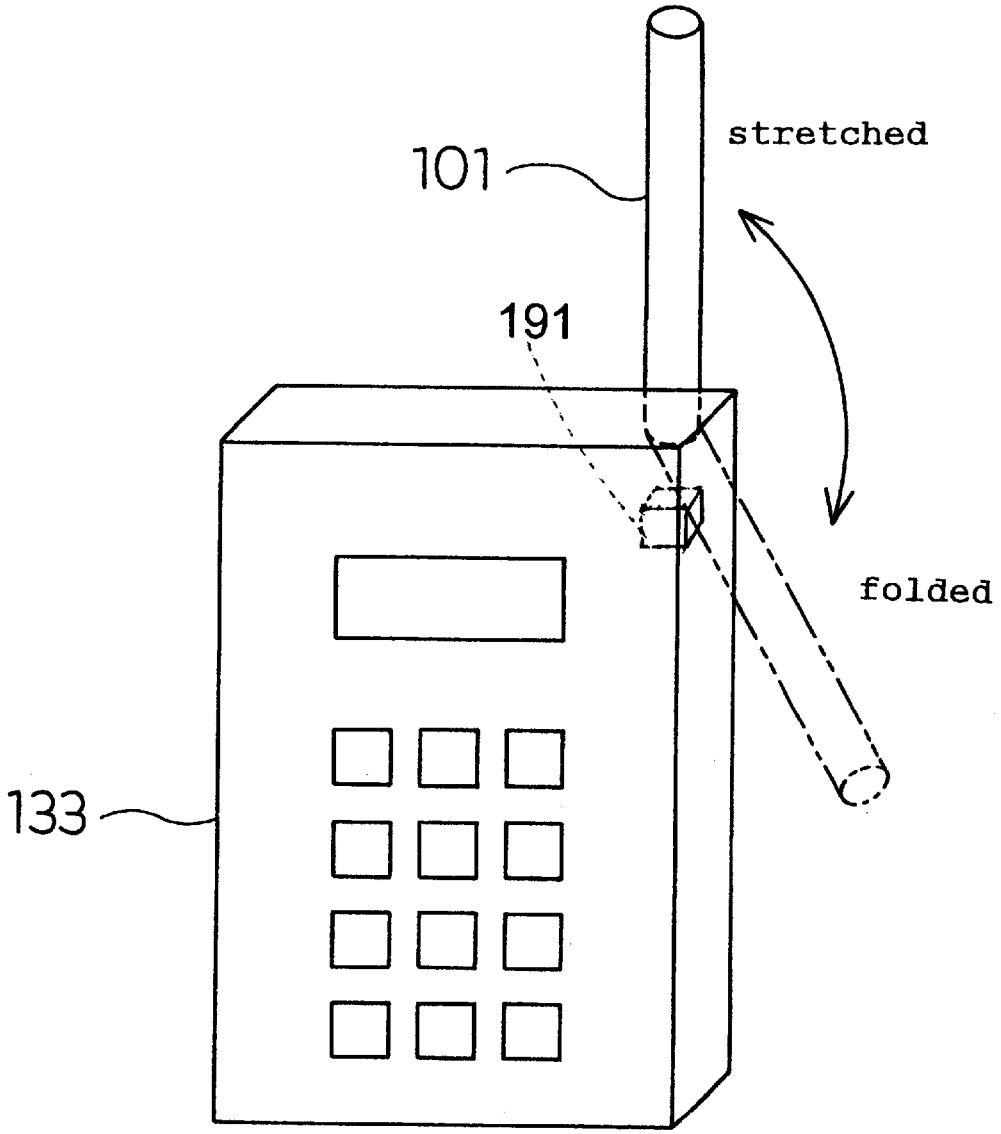
FIG. 8 is a view showing the quadrifilar helical antenna according to the preferred embodiment attached to a satellite portable telephone, as it is stretched and folded.
Figure 9:
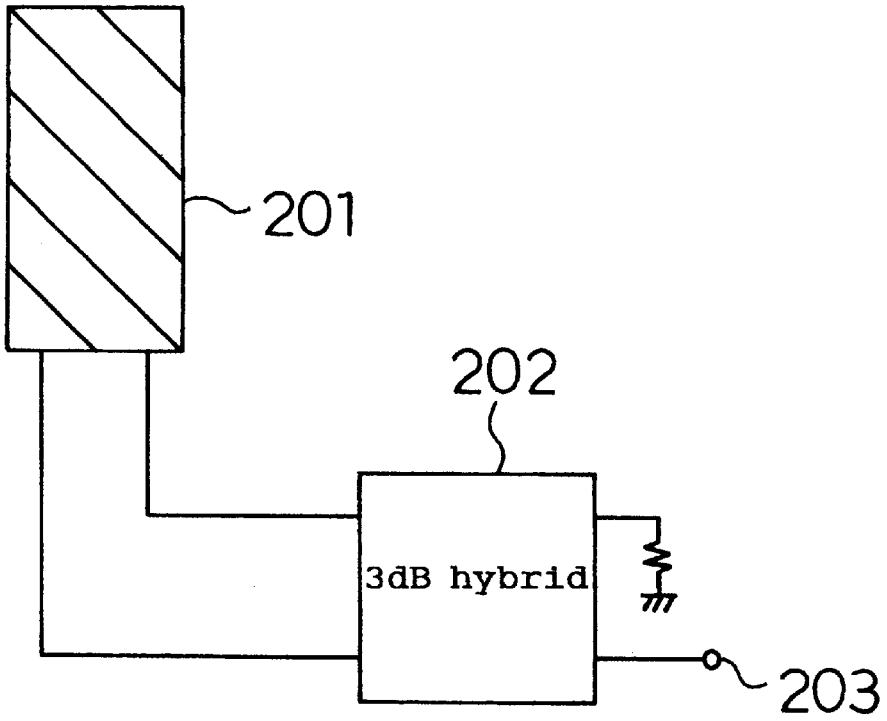
Fig. 9 PRIOR ART
FIG. 9 is a block diagram of a conventional quadrifilar helical antenna.
Figure 10:
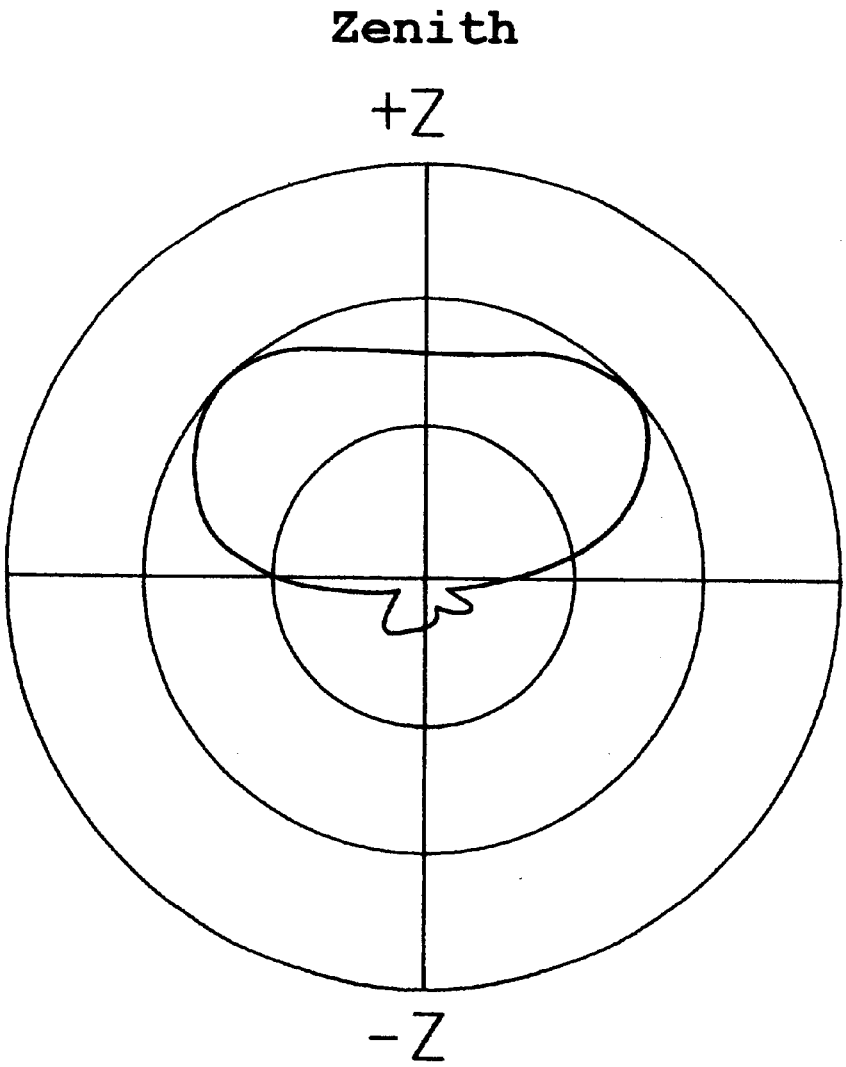
Fig. 10 PRIOR ART
FIG. 10 is a view showing a radiant pattern of the conventional quadrifilar helical antenna.

As described above, according to the preferred embodiment, the switch is disposed before the 3 dB hybrid which is used to feed signal to the quadrifilar helical antenna, and therefore, it is possible to switch the directivity of radiation pattern of the antenna between the direction +z and the direction −z. Further, since the terminal which does not carry a signal received from the 3 dB hybrid is terminated at switching, this operation is more stable.

Where the quadrifilar helical antenna 101 according to the preferred embodiment is attached to a satellite portable telephone 133 as shown in FIG. 8 in a foldaway fashion, as the directivity of radiation pattern is switched between when the antenna 101 is stretched and when the antenna 101 is folded, the antenna can always receive an radio wave from above. In this case, a mechanical switch 191 may be disposed in the vicinity of a supporting point around a base of the antenna 101, so that when the antenna 101 is manipulated, a control signal is sent to the control terminal 105 from this switch and the switch 103 accordingly switches over.

As described above, when a switch is disposed before the feed circuit of the quadrifilar helical antenna, it is possible to switch the directivity of radiation pattern of the antenna between an upward direction and a downward direction. Further, when the quadrifilar helical antenna 101 according to the present invention is attached to a satellite portable telephone, it is possible to switch the directivity of radiation pattern of the antenna depending on whether the antenna is stretched or folded, and hence, to direct the directivity of radiation pattern of the antenna always to an upward direction. Still further, at switching, as the terminal which does not carry a signal received from the 3 dB hybrid is terminated, the operation becomes more stable.

While the preferred embodiment described above requires that the hollow resin cylinder 131 is made of teflon, this is not limiting. Instead, the cylinder may be made of other resins such as polypropylene. Further, while the foregoing has described that copper wires are used as the antenna elements 132, a similar effect is maintained even when metal elements are printed or plated directly on the hollow resin cylinder 131.

Figure 7:
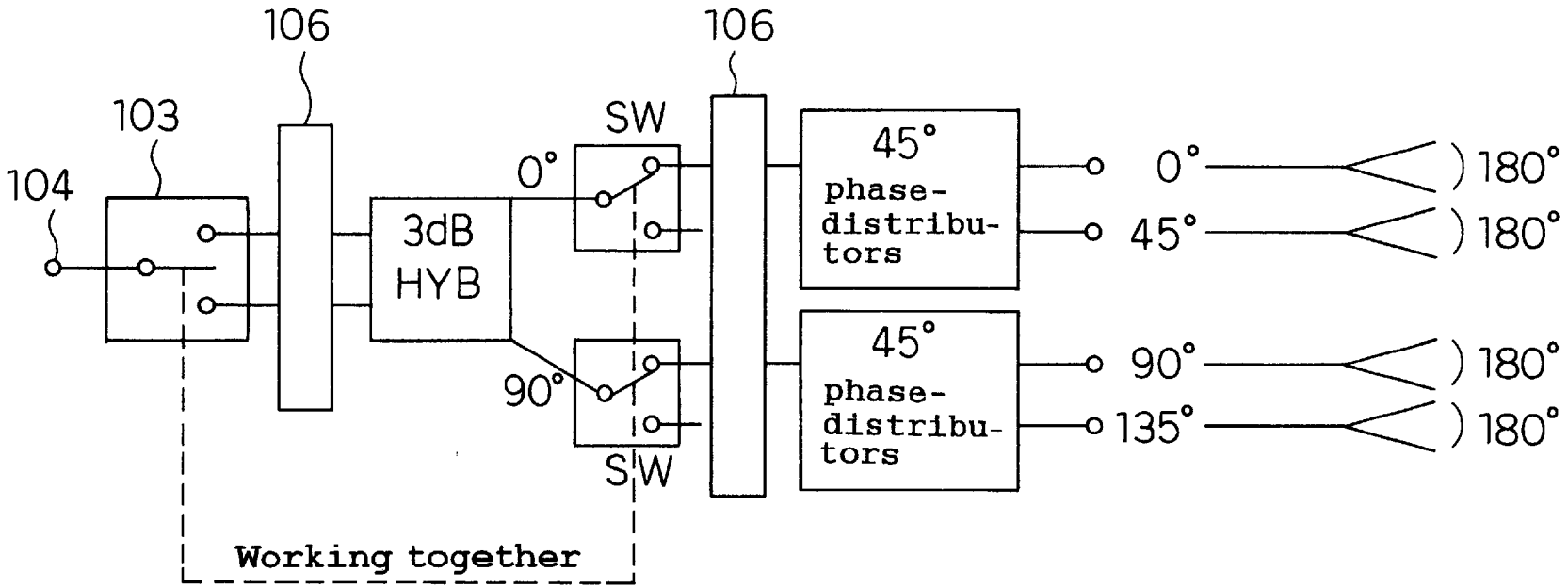
FIG. 7 is a circuitry diagram of a phase control circuit of an octafiler helical antenna according to the preferred embodiment of the present invention.

The present invention does not limit the number of wound wires to four. Rather, eight wires may be wound, in which case the phase control circuit may be designed as shown in FIG. 7. More specifically, using one 3 dB hybrid, two 45-degree phase-distributors and two switches, it is possible to form the phase control circuit.

What is claimed is:

1. A multi-filar helical antenna, comprising:

an antenna radiant section which comprises n elements which are wound in spiral;

two feeding lines which are connected to said antenna radiant section and have substantially a same electrical line length;

a switch having an input terminal connectible to receive an I/O signal thereon and a first selectible output terminal and a second selectible output terminal;

a 3 dB hybrid having four terminals, said four terminals of said hybrid including a first input side terminal connected to said first switch output terminal and a second input side terminal connected to said second switch output terminal, a first output side terminal connected to one of said feeding lines and a second output side terminal connected to the other of said feeding lines, whereby said switch determines radiant directivity of said antenna radiant section according to whether said switch connects its said input terminal to its said first selectible output terminal whereupon said radiant section is oriented along a first directivity, or whether said switch connects its said input terminal to its said second selectible output terminal whereupon said radiant section is oriented along a second directivity, different from said first directivity;

terminating circuits including a first terminating circuit electrically connected between said first switch output terminal and said hybrid's first input side terminal for terminating signals from said hybrid's first input terminal when said switch connects its said input terminal to its said second selectible output terminal, and a second terminating circuit electronically connected between said second switch output terminal and said hybrid's second input side terminal for terminating signals from said hybrid's second input terminal when said switch connects its said input terminal to its said first selectible output terminal.

2. The multi-filar helical antenna of claim 1, wherein said two terminating circuits each include at least:

a series connection circuit with a diode and a terminating resistor; and two control terminals which are disposed at both end portions of said series connection circuit.

3. The multi-filar helical antenna of claim 1, wherein said 3 dB hybrid controls the phase of feed signals applied to said feeding lines and thus to said n elements in an order of arrangement of said n elements to either delay the phase of certain signals by 360°/n or advance the phase of certain signals by 360°/n.

4. The multi-filar helical antenna of claim 3, wherein said antenna includes n/2 feeding lines, each one of said feeding lines including two terminals for outputting signals which are out of phase by 180 degrees with respect to each other, said terminals being connected to said n elements, and said feed signals being applied upon said n/2 feeding lines.

5. A portable radio terminal, comprising:

a multi-filar helical antenna including an antenna radiant section which comprises n elements which are wound in spiral, two feeding lines which are connected to said antenna radiant section and have substantially a same electrical line length, a switch having an input terminal connectible to receive an I/O signal thereon and a first selectible output terminal and a second selectible output terminal, a 3 dB hybrid having four terminals, said four terminals of said hybrid including a first input side terminal connected to said first switch output terminal and a second input side terminal connected to said second switch output terminal, a first output side terminal connected to one of said feeding lines and a second output side terminal connected to the other of said feeding lines, whereby said switch determines radiant directivity of said antenna radiant section according to whether said switch connects its said input terminal to its said first selectible output terminal whereupon said radiant section is oriented along a first directivity, or whether said switch connects its said input terminal to its said second selectible output terminal whereupon said radiant section is oriented along a second directivity, different from said first directivity, terminating circuits including a first terminating circuit electrically connected between said first switch output terminal and said hybrid's first input side terminal for terminating signals from said hybrid's first input terminal when said switch connects its said input terminal to its said second selectible output terminal, and a second terminating circuit electronically connected between said second switch output terminal and said hybrid's second input side terminal for terminating signals from said hybrid's second input terminal when said switch connects its said input terminal to its said first selectible output terminal; and a radio device to which said multiple-wire wound helical antenna is attached in a foldaway fashion, wherein said switch switches between connecting its said input terminal with its said first and second output terminals in accordance with a condition of said multiple-wire wound helical antenna.

6. A portable radio device comprising:

a multi-filar helical antenna including an antenna radiant section which comprises n elements which are wound in spiral, two feeding lines which are connected to said antenna radiant section and have substantially a same electrical line length, a switch having an input terminal connectible to receive an I/O signal thereon and a first selectible output terminal and a second selectible output terminal, a 3 dB hybrid having four terminals, said four terminals of said hybrid including a first input side terminal connected to said first switch output terminal and a second input side terminal connected to said second switch output terminal, a first output side terminal connected to one of said feeding lines and a second output side terminal connected to the other of said feeding lines, whereby said switch determines radiant directivity of said antenna radiant section according to whether said switch connects its said input terminal to its said first selectible output terminal whereupon said radiant section is oriented along a first directivity, or whether said switch connects its said input terminal to its said second selectible output terminal whereupon said radiant section is oriented along a second directivity, different from said first directivity, terminating circuits including a first terminating circuit electrically connected between said first switch output terminal and said hybrid's first input side terminal for terminating signals from said hybrid's first input terminal when said switch connects its said input terminal to its said second selectible output terminal, and a second terminating circuit electronically connected between said second switch output terminal and said hybrid's second input side terminal for terminating signals from said hybrid's second input terminal when said switch connects its said input terminal to its said first selectible output terminal; and a mechanical switch disposed at a base of said multiple-wire wound helical antenna, said mechanical switch being turned on or off when said antenna is folded and comes into contact with said mechanical switch.

7. A multi-filar helical antenna, comprising:

an antenna radiant section which comprises n elements which are wound in spiral;

two feeding lines which are connected to said antenna radiant section and have substantially a same electrical line length;

an input switch having an input terminal connectible to receive an I/O signal thereon and a first selectible output terminal and a second selectible output terminal;

intermediate switch means having a first input terminal, a first selectible output terminal, and a second selectible output terminal; a second input terminal, a third selectible output terminal, and a fourth selectible output terminal;

a 3 dB hybrid having four terminals, said four terminals of said hybrid including a first input side terminal connected to said first output terminal of said input switch and a second input side terminal connected to said second output terminal of said input switch, a first output side terminal connected to said first input terminal of said intermediate switch means and a second output side terminal connected to said second input terminal of said intermediate switch means, whereby said input switch determines radiant directivity of said antenna radiant section according to whether said input switch connects its said input terminal to its said first selectible output terminal whereupon said radiant section is oriented along a first directivity, or whether said input switch connects its said input terminal to its said second selectible output terminal whereupon said radiant section is oriented along a second directivity, different from said first directivity;

upstream terminating circuit means connected between said first output terminal of said input switch and said hybrid's first input side terminal for terminating signals from said hybrid's first input terminal when said input switch connects its said input terminal to its said second selectible output terminal, and connected between said second switch output terminal of said input switch and said hybrid's second input side terminal for terminating signals from said hybrid's second input terminal when said input switch connects its said input terminal to its said first selectible output terminal;

downstream terminating circuit means having input terminals connected to at least two of said output terminals of said intermediate switch means, and output terminals; and phase distributing means connected to said output terminals of said downstream terminating circuit means, said phase distributing means including two forty-five degree phase distributors.

* * * * *